United States Patent [19]

Burke et al.

[11] 4,142,902

[45] Mar. 6, 1979

[54] ELECTROLESS GOLD PLATING BATHS

[75] Inventors: Aaron R. Burke, Harrison Township, County of Montgomery, Ohio; William V. Hough, Evans City; Gerald T. Hefferan, Butler, both of Pa.

[73] Assignee: Mine Safety Appliances Company, Pittsburgh, Pa.

[21] Appl. No.: 867,702

[22] Filed: Jan. 9, 1978

Related U.S. Application Data

[63] Continuation-in-part of Ser. No. 743,220, Nov. 19, 1976, abandoned.

[51] Int. Cl.[2] ..... C23C 3/02

[52] U.S. Cl. ..... 106/1.23; 427/430 A; 427/437

[58] Field of Search ..... 106/1.23; 427/437, 430 A

[56] References Cited

U.S. PATENT DOCUMENTS 4,005,229 1/1977 Miller et al. ..... 106/1.23

*Primary Examiner*—Lorenzo B. Hayes

[57] ABSTRACT

Improved electroless gold plating baths, free of cyanide ion, comprise an alkaline aqueous solution of a soluble gold (III) salt and an ether substituted tertiary amine borane. Metallic and non-metallic substrates having catalytically activated surfaces are plated by immersing the substrate in the plating bath.

8 Claims, No Drawings

ELECTROLESS GOLD PLATING BATHS

CROSS REFERENCES

This application is a continuation-in-part of Ser. No. 743,220 filed Nov. 19, 1976, now abandoned.

The water soluble amine boranes used in the baths of this invention are described in the copending application Ser. No. 743,221 filed Nov. 19, 1976 of W. V. Hough and A. R. Burke and Water Soluble Tertiary Amine Boranes of common ownership herewith.

BACKGROUND OF THE INVENTION

Electroless gold plating baths are known comprising a solution of complexed gold salts and, as a reducing agent, an alkali metal borohydride or amine borane wherein the amine is a primary or secondary amine, usually dimethylamine borane. Such baths have all used cyanide, generally alkali metal cyanides, as gold complexing agents, either alone or together with other complexing agents. The use of toxic cyanides is undesirable as it poses severe environmental and health hazards. Prior baths have also been deficient in providing both bath stability and practical plating rates. It has been necessary heretofore to heat the plating baths to obtain practical plating rates. Such gold plating baths are described in U.S. Pat. Nos. 3,589,916; 3,700,469 and 3,917,885.

SUMMARY OF THE INVENTION

It is an object of this invention to provide an electroless gold plating bath of excellent stability that does not require the use of cyanide ion. A further object is to provide such a bath consisting essentially of a solution of a gold (III) salt and a tertiary amine borane reducing agent. Another object is to provide an electroless gold plating bath that can be used at room temperature.

The invention is based on our discovery that an aqueous solution of a water soluble gold (III) salt and a water soluble ether substituted tertiary amine borane, maintained at a pH above about 12 preferably above 13, is stable and autocatalytically plates gold on a metallic substrate or non-metallic substrates having catalytically activated surface. Practical plating rates are obtained at room temperature and increased plating rates are obtained at higher temperatures, suitably up to about 70° C., the bath retaining its excellent stability at such temperatures.

Gold is provided to the baths as a soluble gold (III) salt, such as, for example, halides acetates, nitrates or sulfates of gold and corresponding alkali metal gold salts, most suitably alkali metal gold halides such as $KAuCl_4$. Gold salts having anions deleterious to the plating process should be avoided and, of course, gold cyanide salts, although operable, are undesirable in order to obtain the benefits of a bath free of cyanide ion.

The mild reducing agents used in the bath are water soluble tertiary amine boranes of the formula $$RO(C_aH_{2a}O)_xC_bH_{2b}NR'R''BH_3$$

in which a is zero or an integer, x is zero or an integer, b is an integer, and R, R' and R'' are alkyl groups.

The most readily available amines and ethers have lower alkyl groups containing up to five carbon atoms, and, in the case of polyethers, up to five ether oxygen atoms, usually polymethylene, polyethylene or polypropylene glycol dialkyl ethers, from which are derived the preferred tertiary amine boranes in which a is zero or an integer from 1 to 3 x is zero or an integer from 1 to 4 b is an integer from 1 to 5, and

R, R' and R'' are alkyl groups containing up to 5 carbon atoms.

Of these, tertiary amines having a polyether substituent, (where x is an integer) are most preferred as they are more soluble in water than those tertiary amines having a simple ether substituent (where x is zero).

Ether substituted amines can be derived from the aforementioned ethers and amines by conventional organic synthesis. For example a halogen substituted amine and a metal alkoxide can be reacted according to $$RO(C_aH_{2a}O)M + XC_bH_{2b}NR'R'' \rightarrow RO(C_aH_{2a}O)_xC_bH_{2b}NR'R'' + MX$$

wherein M is alkali metal and X is a halogen. The new amine boranes are preferably prepared by reaction of the appropriate ether substituted amine with dimethylsulfide borane according to the equation $$RO(C_aH_{2a}O)_xC_bH_{2b}NR'R'' + (CH_3)_2SBH_3 \rightarrow = RO(C_aH_{2a}O)_xC_bH_{2b}NR''R'BH_3 + (CH_3)_2S,$$

suitably in accordance with the procedure of the following example: Two Hundred milliliters of distilled dimethylsulfide (DMS) and 122.5 g (523.5 mmol) of $CH_3O(C_2H_4O)_3C_2H_4N(CH_3)_2$ were added to a one liter three necked flask equipped with a magnetic stirring bar, a thermometer and a 250 ml pressure equalizing dropping funnel. 41.4 grams (523.5 mmol) of dimethylsulfide borane (DMSB) was added to the funnel. The DMSB was added dropwise over the next hour while maintaining the reaction vessel temperature between 7°-15° C. with ice water cooling. After the reaction was complete, the DMS solvent was removed under vacuum. The remaining liquid ether substituted tertiary amine borane was very soluble in water.

The pH of the bath is maintained at a pH above about 12 and preferably above 13, to prevent spontaneous decomposition of the bath resulting in precipitation of the gold. It is preferred to add an alkali metal hydroxide, such as NaOH or KOH, in an amount sufficient to maintain the pH level. Other alkali metal buffering salts may also be used to facilitate pH control in accordance with conventional practice in other electroless gold plating baths.

The catalytic surfaces that can be plated with the baths of this invention include a large group of metallic surfaces, such as nickel, cobalt, iron, steel, palladium, platinum, copper and other elemental metals and alloys, for example, such as Kovar. The surfaces are usually sensitized by treatments well known in the art. Plastic, glass and ceramic surfaces are generally not catalytic but these surfaces can be made active by providing a thin film of active particles thereon. There are a variety of well known methods for such sensitization including treatment of the surface with an acidic stannous chloride solution and sequentially an acidic solution of palladium chloride.

When a substrate with a catalytically active surface is immersed in our new bath an adherent, bright gold plate forms on the surface. Plating rates of about 15 microinches per hour are typically obtained at room temperature, while plating rates several times faster are obtainable at temperatures up to about 70° C.

Since the new baths are inherently stable at high pH, by virtue of the selective matching of the reducibility of gold salts with the mild reducing ability of the tertiary amine boranes, stability is not as concentration sensitive as is the case in many prior baths depending on complexing agents to provide stability. Plating rates are dependent to some extent on concentrations and generally we prefer to use gold salts in concentrations between about 0.0005 and 0.004 Molar and amine boranes in concentrations between about 0.01 and 0.02 Molar.

PREFERRED EMBODIMENTS OF THE INVENTION

EXAMPLE 1

The pH of one hundred ml of a 3.0 g/l solution of $KAuCl_4$ was raised to 12.5 by the addition of NaOH. In a separate beaker, the pH of 100 ml of a 2.00 g/l solution of $CH_3OCH_2CH_2N(CH_3)_2BH_3$ was also raised to 12.5 by the addition of NaOH. These two solutions were mixed with stirring and the resulting solution remained clear and stable. The surface of a nickel plate substrate was activated by (a) dipping for 20 seconds in an aqua region to clear etch the surface, (b) rinsing with distilled water and the dipping in a 0.5% $PdCL_2$ solution, and (c) rinsing with distilled water and then dipping in an amine borane solution for 2 minutes following with a thorough rinse with distilled water. The activated substrate of nickel plate was immersed in the stirred bath for one hour at room temperature. Plating was noted immediately and after one hour a weight increase of 0.34mg/cm$^2$ was measured.

EXAMPLE 2

A bath of the same formulation as in Example 1 was heated to 71° C. A palladium chloride activated substrate of nickel plate was immersed in the stirred bath for 90 minutes. Plating was noted immediately and a weight increase of 1.52 mg/cm$^2$ was measured. The bath remained clear and colorless after the plating test was completed.

EXAMPLE 3

The pH of 100 ml of a 3.0 g/l solution of $KAuCl_4$ was raised to 14.0 by the addition of KOH. In a separate beaker the pH of 100 ml of 2.0 g/l solution of $CH_3OCH_2CH_2N(CH_3)_2BH_3$ was also raised to 14.0 by the addition of KOH. The two solutions were mixed with stirring and the resulting solution remained clear and stable. A palladium chloride activated substrate of nickel plate was immersed in the stirred bath for two hours at room temperature. Plating was noted immediately and a weight gain of 2.13 mg/cm$^2$ was measured. The bath was then heated to 45° C. and another activated nickel substrate was immersed. A weight gain of 2.64 mg/cm$^2$ was measured. The bath again remained clear and stable after plating was completed.

EXAMPLE 4

The pH of 100 ml of a 3.0 g/l solution of $KAuCl_4$ was raised to 14.0 by the addition of KOH. In a separate beaker the pH of 100 ml of a 2.1 g/l solution of $CH_3CH_2OCH_2CH_2N(CH_3)_2BH_3$ was also raised to 14.0 by the addition of KOH. These two solutions were mixed with stirring and the resulting solution remained clear and stable. A palladium chloride activated substrate of nickel plate was immersed for two hours at room temperature. Plating was noted immediately and a weight gain of 3.89 mg/cm$^2$ was measured.

EXAMPLE 5

The pH of one hundred ml of a 3.0 g/l solution of $KAuCl_4$ was raised to 14.0 by the addition of KOH. In a separate beaker the pH of 100 ml of a 7.1 g/l solution of $CH_3OCH_2CH_2OCH_2CH_2OCH_2CH_2OCH_2CH_2N(CH_3)_2BH_3$ was raised to 14.0 by the addition of KOH. These two solutions were mixed and the resulting solution remained clear and stable. An activated nickel substrate was immersed for 18 hours at room temperature. A weight gain of 0.42 mg/cm$^2$ was measured. The bath was then heated to 55° C and another activated nickel substrate was immersed. Plating was noted immediately and after one hour a weight gain of 8.64 mg/cm$^2$ was measured. The bath remained clear and stable after plating was completed.

EXAMPLE 6

The pH of one hundred ml of a 3.0 g/l solution of $KAuCl_4$ was raised to 13.8 by the addition of KOH. In a separate beaker the pH of 100 ml of a 4.0 g/l solution of $CH_3OCH_2CH_2(OCH_3)_2BH_3$ was also raised to 13.8 by the addition of KOH. These two solutions were mixed with stirring and the resulting solution remained clear and stable. A Mylar substrate was activated by (a) dipping in a 20% KOH solution at 50° C for 15 minutes, (b) rinsing with distilled water, then dipping for 10 minutes in a 0.5% $PdCl_2$ solution, and (c) rinsing with distilled water and dipping for 5 minutes in a 0.5% dimethylamine borane solution, followed by a thorough distilled water rinse. The palladium chloride activated plastic substrate was immersed for one hour at room temperature. A weight gain of 0.58 mg/cm$^2$ was measured.

EXAMPLE 7

The pH of one hundred ml of a 1.5 g/l solution of $KAuCl_4$ was raised to 13.7 by the addition of KOH. In a separate beaker the pH of 100 ml of 2.0 g/l solution of $CH_3OCH_2CH_2N(CH_3)_2BH_3$ was also raised to 13.7 by the addition of KOH. These two solutions were mixed with stirring and the resulting solution remained clear and stable. A Kovar plate was activated in the same manner as the nickel plate in the prior example, except an alkaline cleaning dip was used. The palladium chloride activated substrate of Kovar plate was immersed in the stirred bath for one hour at room temperature. Plating was noted immediately and a weight increase of 1.53 mg/cm$^2$ was measured. This sample was then reimmersed for 17 hours at room temperature and an additional weight gain of 1.53 mg/cm$^2$ was measured. The total weight gain in 18 hours was 3.06 mg/cm$^2$.

While the preferred embodiments have been described with particularity, it will be recognized the invention may be otherwise embodied within the scope of the claims.

We claim:

1. In a cyanide free electroless gold plating bath consisting essentially of an aqueous solution of a gold (III) salt and a reducing agent therefor, the improvement of a tertiary amine borane reducing agent of the formula $$RO(C_aH_{2a}O)_xC_bH_{2b}NR'R''BH_3$$

wherein a is a zero or an integer from 1 to 3, x is zero or an integer from 1 to 4, b is an integer from 1 to 5 and R, R′ and R″ are alkyl groups containing up to 5 carbon atoms, said bath being maintained at a pH above about 12.

2. The bath of claim 1 in which the pH is maintained by the addition of alkali metal hydroxide thereto.

3. The bath of claim 1 in which the pH is greater than 13.

4. The bath of claim 1 in which the gold salt is an alkali metal gold halide.

5. The bath of claim 1 in which the amine borane contains at least two oxygen atoms.

6. The bath of claim 1 in which the concentration of gold salt is between about 0.0005 and 0.004 M, and the concentration of amine borane is between about 0.01 and 0.02 M.

7. The bath of claim 1 in which the pH is greater than 13, the concentration of gold salt is between about 0.0005 and 0.004 M and the concentration of the amine borane is between about 0.01 and 0.02 M.

8. In a method of gold plating a substrate having a catalytically active surface comprising contacting said substrate with a bath consisting essentially of an aqueous solution of a gold (III) salt and a reducing agent therefor, the improvement of a tertiary amine borane reducing agent of the formula $$RO(C_aH_{2a}O)_xC_bH_{2b}NR'R''BH_3$$

wherein a is zero or an integer from 1 to 3, x is zero or an integer from 1 to 4, b is an integer from 1 to 5 and R, R′ and R″ are alkyl groups containing up to 5 carbon atoms, said bath being maintained at a pH above about 12.

* * * * *